US007628020B2

(12) United States Patent
Alkabie et al.

(10) Patent No.: US 7,628,020 B2
(45) Date of Patent: Dec. 8, 2009

(54) COMBUSTOR WITH IMPROVED SWIRL

(75) Inventors: Hisham Alkabie, Oakville (CA); Oleg Morenko, Oakville (CA); Kian McCaldon, Orangeville (CA)

(73) Assignee: Pratt & Whitney Canada Cororation, Longueuil, Québec (CA)

( * ) Notice: Subject to any disclaimer, the term of this patent is extended or adjusted under 35 U.S.C. 154(b) by 501 days.

(21) Appl. No.: 11/441,223

(22) Filed: May 26, 2006

(65) Prior Publication Data

US 2007/0271925 A1 Nov. 29, 2007

(51) Int. Cl.
*F02C 3/00* (2006.01)

(52) U.S. Cl. ..... 60/752; 60/804

(58) Field of Classification Search ..... 60/752, 60/804

See application file for complete search history.

(56) References Cited

U.S. PATENT DOCUMENTS

| | | | | |
|---|---|---|---|---|
| 2,654,219 | A | 10/1953 | Zaba | |
| 4,422,300 | A | 12/1983 | Dierberger et al. | |
| 4,695,247 | A | 9/1987 | Enzaki et al. | |
| 5,184,455 | A | 2/1993 | Ewing et al. | |
| 5,216,886 | A | 6/1993 | Ewing | |
| 5,435,139 | A | 7/1995 | Pidcock et al. | |
| 5,528,904 | A | 6/1996 | Jones et al. | |
| 5,598,697 | A | 2/1997 | Ambrogi et al. | |
| 5,687,572 | A | 11/1997 | Schrantz et al. | |
| 5,758,504 | A | 6/1998 | Abreu et al. | |
| 6,282,905 | B1 | 9/2001 | Sato et al. | |
| 6,330,791 | B1 | 12/2001 | Kendall et al. | |
| 6,351,947 | B1 | 3/2002 | Keller et al. | |
| 6,530,221 | B1 | 3/2003 | Sattinger et al. | |
| 6,546,731 | B2 | 4/2003 | Alkabie et al. | |
| 6,640,544 | B2 | 11/2003 | Suenaga et al. | |
| 6,698,206 | B2 | 3/2004 | Scarinci et al. | |
| 6,955,053 | B1 * | 10/2005 | Chen et al. | 60/804 |
| 6,964,170 | B2 | 11/2005 | Alkabie | |
| 6,988,369 | B2 * | 1/2006 | Conete et al. | 60/796 |
| 2002/0108374 | A1 * | 8/2002 | Young et al. | 60/752 |
| 2004/0060295 | A1 | 4/2004 | Mandai et al. | |
| 2004/0211188 | A1 * | 10/2004 | Alkabie | 60/772 |
| 2006/0016191 | A1 * | 1/2006 | Woodcock et al. | 60/754 |
| 2006/0042263 | A1 * | 3/2006 | Patel et al. | 60/776 |
| 2006/0042271 | A1 | 3/2006 | Morenko et al. | |
| 2007/0234727 | A1 * | 10/2007 | Patel et al. | 60/754 |
| 2007/0271926 | A1 * | 11/2007 | Alkabie | 60/772 |

* cited by examiner

*Primary Examiner*—Michael Cuff
*Assistant Examiner*—Phutthiwat Wongwian
(74) *Attorney, Agent, or Firm*—Ogilvy Renault

(57) ABSTRACT

A combustor having a combustor wall with a plurality of angled effusion holes defined therethrough. The tangential component of the hole direction of the effusion holes corresponds to a same rotational direction about the central axis of the combustor. The effusion holes directional arrangement is angled from a radial plane and the combustor liner surfaces in order to promote swirl at the combustor exit.

9 Claims, 4 Drawing Sheets

COMBUSTOR WITH IMPROVED SWIRL

TECHNICAL FIELD

The invention relates generally to gas turbine engines and, more particularly, to an improved combustor for such engines.

BACKGROUND OF THE ART

In a gas turbine engine, either axial or radial air entry swirlers are generally used in order to stabilize the flame in the combustor and promote mixing, more specifically at the primary zone region of the combustor. However, the swirl of the flow can decay along the combustor length due to various effect and phenomenon mostly related to the viscous forces and pressure recovery/redistribution. The wall friction also plays some part in reducing the swirl effect near the combustor wall region, by reducing the tangential component of the flow velocity.

The swirl decay thus causes quenching at the wall region, which usually increases unburnt hydrocarbons (UHC), leading to combustion inefficiency and high engine specific fuel consumption (SFC). A conventional way of reducing UHC includes increasing the temperature of the primary combustor section and defining effusion holes in the combustor wall, usually normal thereto, in selected area to push away and accelerate the flow attached to the wall region. However, the normal effusion flow in the primary zone generally creates a fresh supply of oxidant in an area of low flow velocity which, when combined with the high temperature of the combustor wall, usually limits the life of the combustor.

Also, the reduction in the tangential component of the flow velocity also usually leads to an increase in the axial component of the flow velocity, hence to a reduction in mixing between the hot combustion products and the dilution air entering the compressor, and to a reduction of the residence time of the flow in the hot path leading to the compressor turbine (CT) vanes. In addition, the loss of swirl reduces the angle of attack of the hot combustion gases exiting the combustor on the CT vanes, which usually reduces the life and performance thereof.

In order to correct the usual loss of swirl along the combustor, a longer duct or larger CT vanes can be used to improve mixing between the hot combustion products and the dilution air and increase the angle of attack of the hot combustion gases on the CT vanes. The geometrical angle of the compressor's diffuser pipe can also be increased, but due to the physical restriction of how much the diffuser pipes can be turned, such an angle increase usually necessitate the diffuser carrier disc to be larger. These solutions thus generally increase engine size, cost and weight.

Accordingly, improvements are desirable.

SUMMARY OF THE INVENTION

It is therefore an object of this invention to provide an improved combustor.

In one aspect, the present invention provides a combustor comprising inner and outer liners defining an annular enclosure therebetween, the inner and outer liners having a plurality of angled effusion holes defined therethrough, each of the effusion holes having a hole direction defined along a central axis thereof and toward the enclosure, the hole direction of each of the effusion holes having a tangential component defined tangentially to a corresponding one of the liners and perpendicularly to a central axis of the combustor, the tangential component of all of the effusion holes corresponding to a same rotational direction with respect to the central axis of the combustor such as to swirl a flow coming in the enclosure through the effusion holes along the same rotational direction.

In another aspect, the present invention provides a combustor comprising inner and outer liners defining an annular enclosure therebetween, the inner and outer liners having a plurality of angled effusion holes defined therethrough, each of the effusion holes intersecting a corresponding imaginary radial plane extending radially from a central axis of the combustor, each of a plurality of the effusion holes extending at a first angle with respect to a corresponding one of the liners and at a second angle with respect to the corresponding radial plane, the effusion holes directing a flow coming therethrough along a same rotational direction with respect to the central axis.

In a further aspect, the present invention provides a method of increasing a swirl of a gas flow inside a combustor casing, the method comprising introducing an effusion airflow through walls of the combustor casing, and directing the effusion airflow along a direction complementing the swirl of the gas flow, the direction having a tangential component directed along a tangential component of the swirl of the gas flow.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
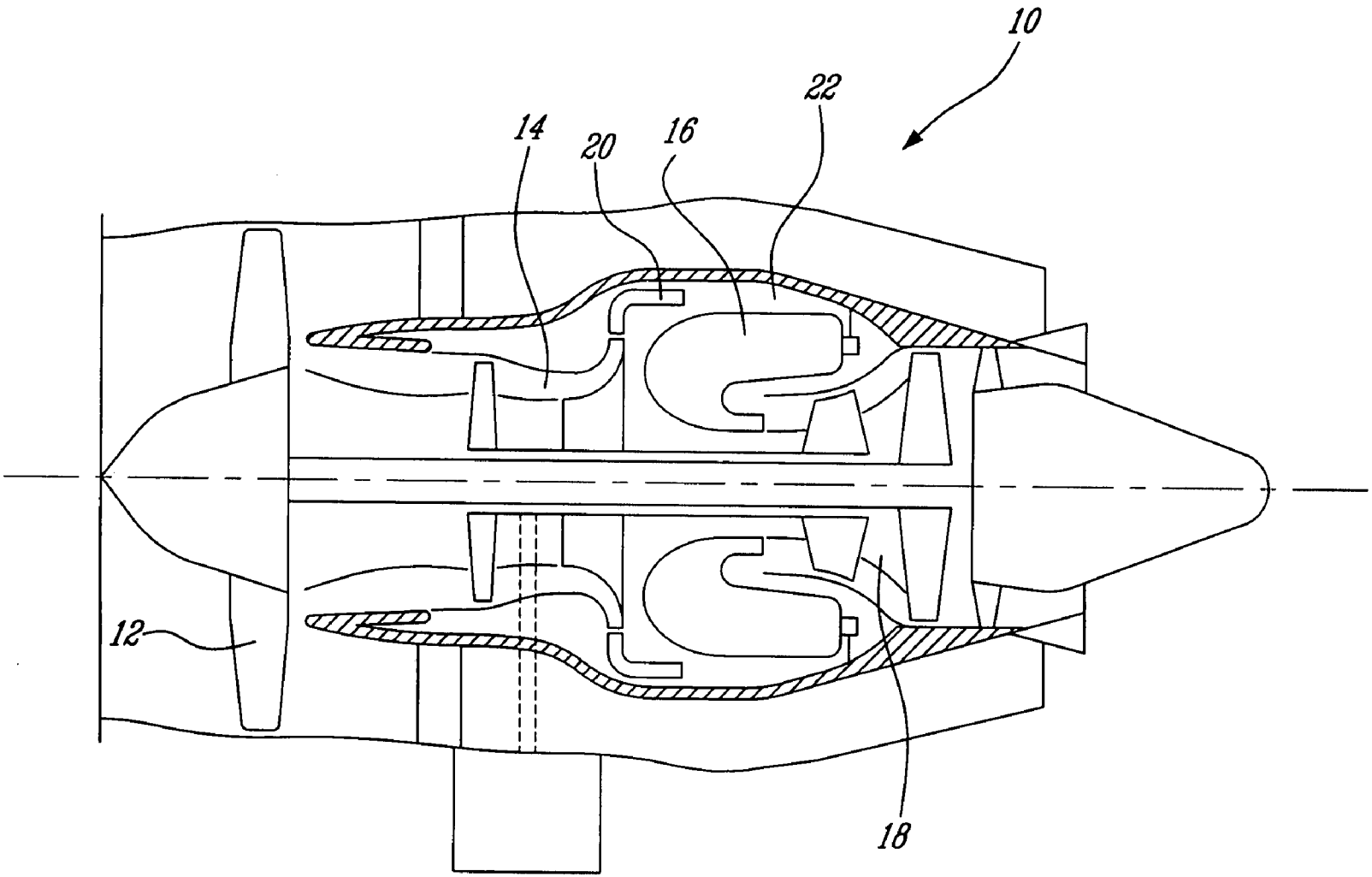
FIG. 1 is a schematic, cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
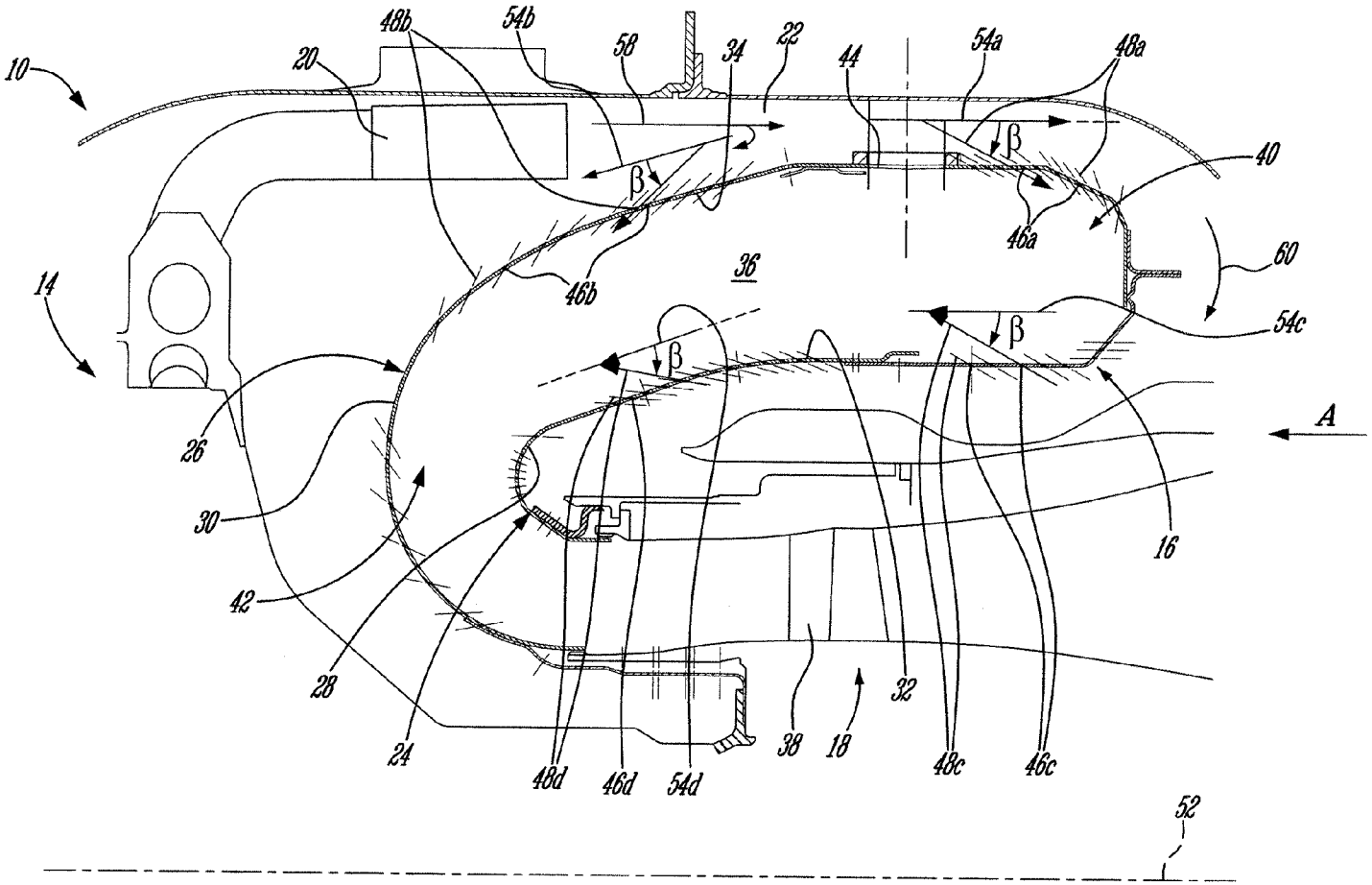
FIG. 2 is a cross-sectional view of part of the gas turbine engine of FIG. 1, including a combustor according to a particular embodiment of the present invention.

Referring to FIG. 2, the air exiting the compressor 14 passes through a diffuser 20 and enters a gas generator case 22 which surrounds the combustor 16. The combustor 16 includes inner and outer annular walls or liners 24, 26 which receive the airflow circulating in the gas generator case on outer surfaces 28, 30 thereof, and which define an annular enclosure 36 between inner surfaces 32, 34 thereof. The inner and outer liners 24, 26 can be interconnected at a dome region of the combustor 16 or be of unitary construction. The annular stream of hot combustion gases travels through the annular enclosure 36 and passes through an array of compressor turbine (CT) vanes 38 upon entering the turbine section 18.

The combustor 16 includes a primary section 40, where the fuel nozzles (not shown) are received, and a downstream section 42, which is defined downstream of the primary section 40. The outer liner 26 has a series of fuel nozzle holes 44 (also shown in FIG. 3A) defined therein in the primary section 40, each hole 44 being adapted to receive a fuel nozzle (not shown). The primary section 40 is the region in which the chemical reaction of combustion is completed, and has the highest flame temperature within the combustor. The downstream section 42 has a secondary zone characterized by first additional air jets to quench the hot product generated by the primary section; and a dilution zone where second additional jets quench the hot product and profile the hot product prior to discharge to turbine section.

Figure 3A:
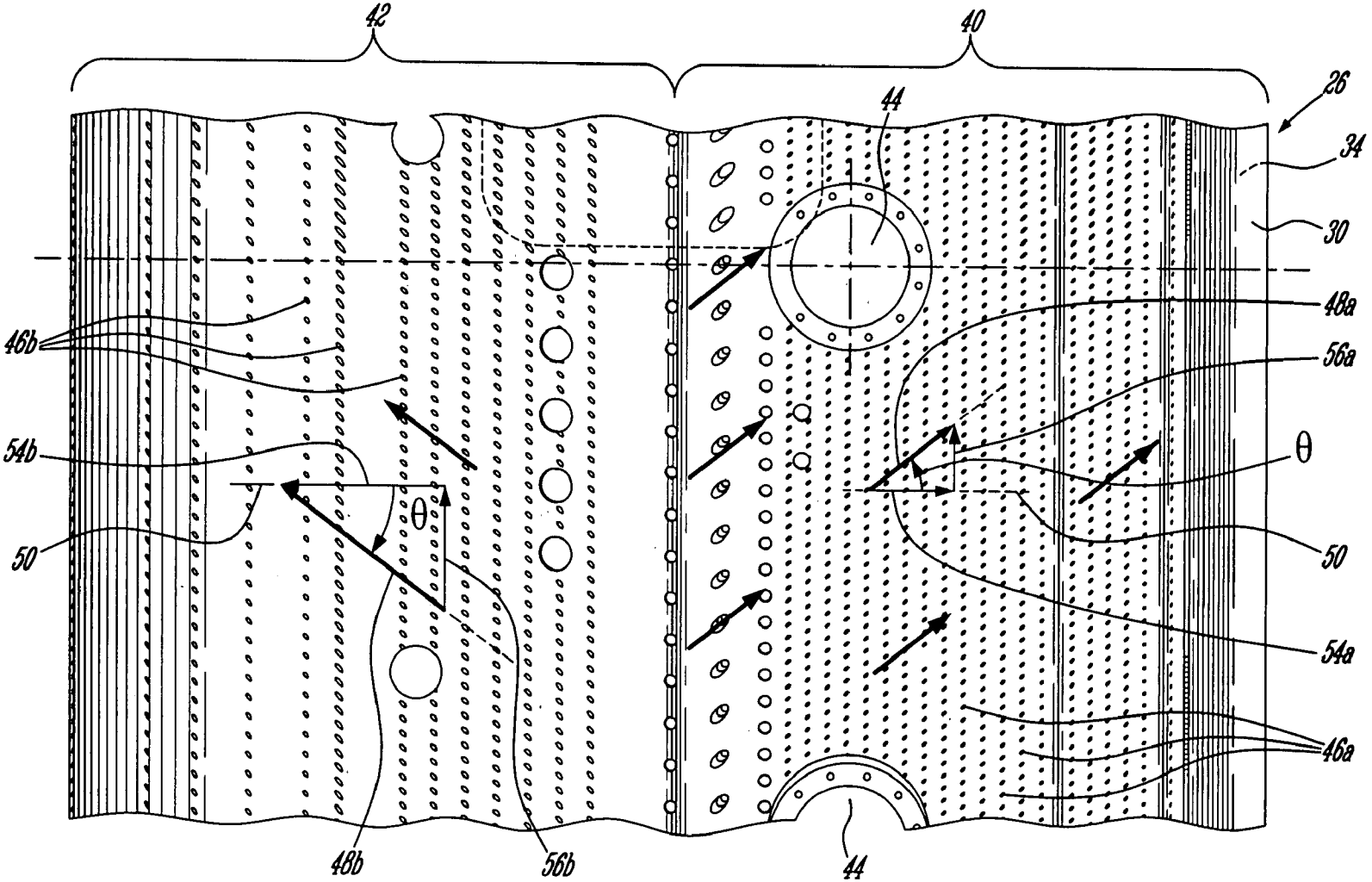
FIG. 3A is a top view of a portion of an outer liner of the combustor of FIG. 2.
Figure 3B:
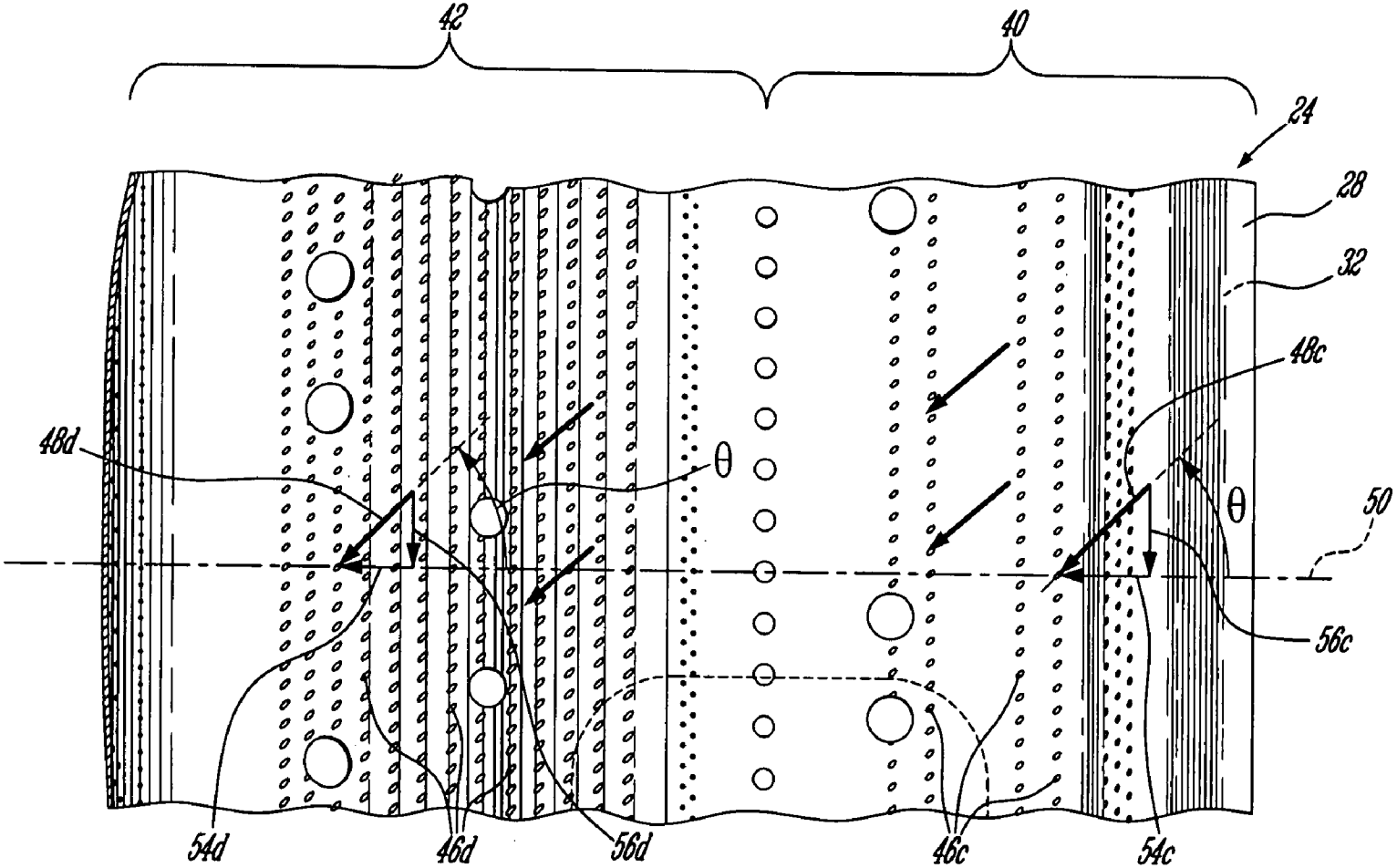
FIG. 3B is bottom view of a portion of an inner liner of the combustor of FIG. 2.

Referring to FIGS. 2, 3A and 3B, the inner and outer liners 24, 26 have a plurality of double orientation effusion holes 46*a,b,c,d* defined therethrough, and through which the airflow within the gas generator case 22 can enter the annular enclosure 36. Each effusion hole 46*a,b,c,d* defines a hole direction 48*a,b,c,d*, extending along a central axis of the hole and directed toward the enclosure 36. The hole direction 48*a,b,c,d* of each effusion hole 46*a,b,c,d* thus also corresponds to the general direction of the velocity of the airflow flowing through that hole 46*a,b,c,d*. In order to characterize the hole directions 48*a,b,c,d*, an imaginary radial plane 50 is defined for each effusion hole 46*a,b,c,d*, extending radially from the central axis 52 (see FIG. 2) of the combustor 16 (i.e. the centerline of the engine) and intersecting the corresponding effusion hole 46*a,b,c,d*, this radial plane 50 being shown for some of the effusion holes 46*a,b,c,d* in FIGS. 3A-3B and corresponding to the plane of the Figure for the effusion holes 46*a,b,c,d* depicted in FIG. 2.

The hole direction 48*a,b,c,d* of each effusion hole 46*a,b,c,d* extends at an acute angle with respect to the corresponding liner 24, 26, the projection β of that angle on the corresponding radial plane 50 being shown in FIG. 2. The projected angle β of each angled effusion hole 46*a,b,c,d* is thus defined as the angle measured from the corresponding liner 24, 26, for example the outer surface 28, 30 thereof, to the projection of the hole direction 48*a,b,c,d* on the corresponding radial plane 50.

The hole direction 48*a,b,c,d* of each effusion hole 46*a,b,c,d* also extends at an acute angle with respect to the corresponding radial plane 50, the projection 0 of that angle on the outer surface 28, 30 of the corresponding liner 24, 26 being shown in FIGS. 3A-3B. The projected angle θ of each angled effusion hole 46*a,b,c,d* is thus defined as the angle measured from the corresponding radial plane 50 to the projection of the hole direction 48*a,b,c,d* on the outer surface 28, 30 of the corresponding liner 24, 26.

Referring to FIGS. 2, 3A and 3B, a longitudinal component 54*a,b,c,d* is defined for each angled hole direction 48*a,b,c,d*, extending tangentially to the corresponding liner inner surface 32, 34 in the radial plane of the hole. The longitudinal component 54*a,b,c,d* of each angled hole direction 48*a,b,c,d* generally corresponds to a longitudinal component of the direction of the velocity of the airflow coming through the corresponding effusion hole 46*a,b,c,d*. Referring to FIGS. 3A-3B, a tangential component 56*a,b,c,d* is defined for each angled hole direction 48*a,b,c,d*, extending tangentially to the corresponding liner inner surface 32, 34 and perpendicularly to the central axis 52 of the combustor 16. The tangential component 56*a,b,c,d*, of each angled hole direction 48*a,b,c,d* generally corresponds to a tangential component of the direction of the velocity of the airflow coming through the corresponding effusion hole 46*a,b,c,d*.

The angled effusion holes 46*a,b* defined in the outer liner 26 are oriented differently in the primary section 40 than in the downstream section 42. Referring to FIG. 2, the orientation of the angle between the outer liner 26 and the hole direction 48*a,b* of the angled effusion holes 46*a,b* defined therethrough is, for all the primary section effusion holes 46*a*, opposite that of all the downstream section effusion holes 46*b*. In other words, the projected angle β of each outer liner effusion hole 46*a,b* defined in one section 40, 42 has a negative (or null) value while the projected angle β of each outer liner effusion hole 46*b,a* defined in the other section 42, 40 has a positive (or null) value. In FIG. 2, this is illustrated by having the projected angles β of the outer liner effusion holes 46*a,b* defined along a clockwise orientation for the primary section effusion holes 46*a* and along a counter clockwise orientation for the downstream section effusion holes 46*b*.

Referring to FIG. 3A, the orientation of the angle between each angled outer liner hole direction 48*a,b* and the corresponding radial plane 50 is, for all the primary section effusion holes 46*a*, opposite that of all the downstream section effusion holes 46*b*. In other words, the projected angle θ of each outer liner effusion hole 46*a,b* defined in one section 40, 42 has a negative (or null) value while the projected angle θ of each outer liner effusion hole 46*b,a* defined in the other section 42, 40 has a positive (or null) value. In FIG. 3A this is illustrated by having the projected angles θ of the outer liner effusion holes 46*a,b* defined along a counter clockwise orientation for the primary section effusion holes 46*a* and along a clockwise orientation for the downstream section effusion holes 46*b*.

Thus, for the angled outer liner effusion holes 46*a,b*, the longitudinal component 54*a* of each angled primary section hole direction 48*a* is directed away from the downstream section 42, while the longitudinal component 54*b* of each angled downstream section hole direction 48*b* is directed away from the primary section 40. As such, the outer liner effusion holes 46*a,b* are angled following the direction of the airflow coming out of the diffuser 20, which is illustrated by arrows 58 (FIG. 2). The tangential component 56*a,b* of each angled hole direction 48*a,b* is directed along a same rotational direction for all the effusion holes 46*a,b* defined in the outer liner 26, which corresponds to the rotational direction of the combustion gases already swirling in the combustor 16. In the embodiment shown, this same rotational direction is the clockwise direction when examined from the viewpoint of arrow A in FIG. 2.

Accordingly, the airflow coming through the angled effusion holes 46*a,b* defined in the outer liner 26 flows along the inner surface 32 of the outer liner 26 towards the turbine section 18, due to the longitudinal component 54*a,b* of the airflow velocity, while swirling following the same rotational direction due to the tangential component 56*a,b* of the airflow velocity.

The effusion holes 46*c,d* defined in the inner liner 24 are oriented similarly in both sections 40, 42. Referring to FIG. 2, the orientation of the angles between the inner liner hole directions 48*c,d* and the inner liner 24 is the same for the primary section effusion holes 46*c* and for the downstream section effusion holes 46*d*. In other words, the projected angles β of the inner liner effusion holes 46*c,d* have either all a negative (or null) value, or all a positive (or null) value. In FIG. 2 this is illustrated by having the projected angle β of all the inner liner effusion holes 46*c,d* defined along a clockwise orientation.

Referring to FIG. 3B, the orientation of the angle between each angled inner liner hole direction 48*c,d* and the corresponding radial plane 50 is the same for the primary section effusion holes 46*c* and for the downstream section effusion holes 46*d*. In other words, the projected angles θ of the inner liner effusion holes 46*c,d* have either all a negative (or null) value, or all a positive (or null) value. In FIG. 3B this is illustrated by having the projected angles θ of all the inner liner effusion holes 46*c,d* defined along a counter clockwise orientation.

Thus, for the angled inner liner effusion holes 46*c,d*, the longitudinal component 54*c* of each primary section hole direction 48*c* is directed toward the downstream section 42, while the longitudinal component 54*d* of each downstream section hole direction 48*d* is directed away from the primary section 40. As such, the inner liner effusion holes 46*c,d* are angled following the direction of the airflow coming out of the diffuser 20 and around the outer liner 26, as illustrated by arrow 60 (FIG. 2). The tangential component 56*c,d* of each angled hole direction 48*c,d* is directed along a same rotational direction for all the effusion holes 46*c,d* defined in the inner liner 24, which is the same rotational direction defined by the outer liner hole directions 48*a,b* described above.

Accordingly, the airflow coming through the angled inner liner effusion holes 46*c,d* flows along the inner surface 32 of the inner liner 24 towards the turbine section 18 due to the longitudinal component 54*c,d* of the airflow velocity, while swirling following the same rotational direction as the airflow coming through the angled outer liner holes 46*a,b* due to the tangential component 56*c,d* of the airflow velocity.

Thus, the airflow swirling in the same rotational direction along the inner surfaces 32, 34 of both liners 24, 26 complements the swirl of the combustion gas flow within the combustor, i.e. the tangential components 56*a,b,c,d* of the velocity of the airflow coming through the effusion holes 46*a,b,c,d* is aligned with the tangential component of the swirling combustion gas flow. As such, the airflow coming through the angled effusion holes 46*a,b,c,d* combats the swirl decay in the combustor 16.

In a particular embodiment, the projected angles β correspond to angles defined between each hole direction 48*a,b,c,d* and the corresponding liner 24, 26 having an absolute value between 20° or 30°, while the absolute value for the projected angles θ between each hole direction 48*a,b,c,d* and the corresponding radial plane 50 is approximately 45°. However, θ can ranged from about 0 degrees to 90 degrees. The values of the projected angles β, θ can be changed and depends on various factors, including the thickness of the combustor liners 24, 26 and the engine application.

In an alternate embodiment, only a portion of the effusion holes 46*a,b,c,d* are angled with respect to the corresponding liner 24, 26 and radial plane 50, the portion being selected according to a desired quantity of additional swirl to be produced. Also, a combination of effusion holes having various projected angles β, θ can alternately be used, including, but not limited to, a first series of effusion holes 46*a,b,c,d* having a projected angle θ of 90° and thus a projected angle θ of 0° despite being angled to the corresponding liner 24, 26 (i.e. no longitudinal component to the flow passing therethrough) combined with a second series of effusion holes 46*a,b,c,d* angled with respect to the corresponding liner 24, 26 and having a projected angle θ of 0° (i.e. no tangential component to the flow passing therethrough), a first series of normal effusion holes 46*a,b,c,d* combined with a second series of angled effusion holes 46*a,b,c,d*, etc.

Because of their orientation, the angled effusion holes 46*a,b,c,d* act as fresh energy to the decaying swirl of the combustion gas flow, with special emphasis along the region of the inner surfaces 32, 34 of the liners 24, 26. The extra swirl provided by the angled effusion holes 46*a,b,c,d* causes increased turbulence intensity in the combustor flow, especially in the vicinity of the inner surfaces 32, 34 of the liners 24, 26, which improves the fuel mixing process. The enhanced fuel mixing promotes a better overall temperature distribution factor (OTDF) and radial temperature distribution factor (RTDF), which helps to create a better aerodynamic efficiency, a better turbine performance and an improved hot end life. Also, the increased turbulence created in the vicinity of the inner surfaces 32, 34 of the liners 24, 26 pushes the unburnt hydrocarbon (UHC) away from the inner surfaces 32, 34 and mixes it with the other combustion products in the primary and downstream sections 40, 42 of the combustor 16.

Also because of their orientation, the angled effusion holes 46*a,b,c,d* produce a larger wall wetted area to the compressor coolant airflow than prior art holes drilled normal or only inclined with respect to the liner surface 28, 30. As such, the angled effusion holes 46*a,b,c,d* achieve a high cooling effectiveness of the combustor walls 24, 26 which generally improves component life. Moreover, the resultant swirl generated by the angled effusion holes 46*a,b,c,d* help to achieve a higher angle of attack of the combustor flow on the CT vanes 38.

Thus, the combustor 16 controls the swirl at the entry of the turbine section 18 (i.e. at the CT vanes 38) and increases that swirl without increasing the dimensions of the engine 10, as opposed to prior solutions such as for example an increase of the angle of the pipes of the diffuser 20 or of the size of the CT vanes 38. Accordingly, smaller diffusers 20 and smaller CT vanes 38 can be used with the combustor 16, thus allowing the dimensions of the engine 10 to be smaller, specifically the dimensions of the gas generator case 22 through the use of a smaller diffuser 20, and the dimensions of the CT vane section through the use of smaller CT vanes 38.

The above description is meant to be exemplary only, and one skilled in the art will recognize that changes may be made to the embodiments described without department from the scope of the invention disclosed. Modifications which fall within the scope of the present invention will be apparent to those skilled in the art, in light of a review of this disclosure, and such modifications are intended to fall within the appended claims.

What is claimed is:

1. A combustor comprising inner and outer liners extending longitudinally from a dome wall about the central axis of the combustor to define an annular enclosure therebetween, the inner and outer liners having a plurality of angled effusion holes defined therethrough, each of the effusion holes having a hole direction defined along a central axis thereof and toward the enclosure, the hole direction of each of the effusion holes having a tangential component defined tangentially to a corresponding one longitudinally extending section of the inner and outer liners and perpendicularly to the central axis of the combustor, the tangential component of all of the effusion holes corresponding to a same rotational direction about the central axis of the combustor to swirl a flow coming in the enclosure through the effusion holes along the same rotational direction, wherein the inner and outer liners define first and second longitudinally extending annular sections of the annular enclosure with the first section being adapted to receive a plurality of fuel nozzles and the second section being located downstream of the first section, the hole direction of each of the effusion holes, in a radial plane having a longitudinal component defined tangentially to the corresponding one of the liners, and wherein the longitudinal component of each of the effusion holes in the first section of the outer liner is directed away from the second section towards the dome wall and the longitudinal component of each of the effusion holes defined in the second section of the outer liner is directed away from the first section and the dome wall.

2. The combustor as defined in claim 1, wherein the hole direction of each of the effusion holes forms an angle having an absolute value of between 20 and 30 degrees with the corresponding one of the liners.

3. The combustor as defined in claim 1, wherein a projection of the hole direction of each of the effusion holes on an outer surface of the corresponding one of the liners forms an angle having an absolute value of approximately 45 degrees with a corresponding radial plane extending radially from the axis of the combustor.

4. The combustor as defined in claim 1, wherein for the inner liner the longitudinal component of each of the effusion holes defined in the first section is directed toward the second section and the longitudinal component of each of the effusion holes defined in the second section is directed away from the first section.

5. A combustor comprising inner and outer liners defining an annular enclosure therebetween, the inner and outer liners having a plurality of angled effusion holes defined therethrough, each of said effusion holes intersecting a corresponding imaginary radial plane extending radially from a central axis of the combustor, each of a plurality of the effusion holes extending at a first angle with respect to a corresponding one of the liners and at a second angle with respect to the corresponding radial plane, the effusion holes directing a flow coming therethrough along a same rotational direction about the central axis, wherein the outer liner has effusion holes with opposite longitudinal components, wherein the inner and outer liners define first and second longitudinally extending annular sections relative to a dome end wall of the annular enclosure, the first section being adapted to receive a plurality of fuel nozzles and the second section being located downstream of the first section, the effusion holes being defined through the inner and outer liners in the first and second sections, the first angle of each of the effusion holes being acute and measured from the corresponding one of the liners with a first orientation, the second angle of each of the effusion holes being acute and measured from the corresponding radial plane with a second orientation, and wherein the first and second orientations of the effusion holes defined in the first section and wherein the first and second orientations of the effusion holes defined in the first section of the outer liner are opposite respectively to the first and second orientations of the effusion holes defined in the second section of the outer liner.

6. The combustor as defined in claim 5, wherein each of the effusion holes extend perpendicularly to the corresponding radial plane, the inner and outer liners having additional effusion holes defined therethrough, each of the additional effusion holes extending at an angle with respect to a corresponding one of the liners and parallel to a corresponding radial plane extending radially from the central axis of the combustor.

7. The combustor as defined in claim 5, wherein the first angle has an absolute value of between 20 and 30 degrees.

8. The combustor as defined in claim 5, wherein a projection of the second angle on an outer surface of the corresponding one of the liners has an absolute value of approximately 45 degrees.

9. The combustor as defined in claim 5, wherein for the inner liner the first and second orientations of the effusion holes defined in the first section are the same respectively as the first and second orientations of the effusion holes defined in the second section.

* * * * *